United States Patent [19]

Tsukii et al.

[11] Patent Number: 5,028,898

[45] Date of Patent: Jul. 2, 1991

[54] COLOR CATHODE-RAY TUBE HAVING DEFLECTION YOKE

[75] Inventors: Michio Tsukii; Kunio Shimada, both of Mobara; Eiichi Nishiyama, Funabashi; Takumi Karasawa, Sakura; Fumiaki Yonai, Mobara; Hiroshi Yoshioka, Mobara; Takashi Atobe, Mobara, all of Japan

[73] Assignee: Hitachi, Ltd., Tokyo, Japan

[21] Appl. No.: 394,658

[22] Filed: Aug. 16, 1989

[30] Foreign Application Priority Data

| | | | |
|---|---|---|---|
| Aug. 24, 1988 | [JP] | Japan | 63-208307 |
| Aug. 24, 1988 | [JP] | Japan | 63-208308 |
| Aug. 24, 1988 | [JP] | Japan | 63-208309 |
| Aug. 24, 1988 | [JP] | Japan | 63-208310 |
| Aug. 24, 1988 | [JP] | Japan | 63-208311 |
| Aug. 24, 1988 | [JP] | Japan | 63-208312 |

[51] Int. Cl.[5] ..... H01F 7/00

[52] U.S. Cl. ..... 335/210; 335/212; 313/425

[58] Field of Search ..... 335/210–213; 313/425–428

[56] References Cited

U.S. PATENT DOCUMENTS

| | | | |
|---|---|---|---|
| 3,725,831 | 4/1973 | Barbin | 335/210 |
| 4,095,260 | 6/1978 | Suzuki | 335/210 |
| 4,110,793 | 8/1978 | Tajiri | 335/210 |
| 4,117,516 | 9/1978 | Yasuhara | 335/210 |
| 4,138,628 | 2/1979 | Smith | 335/368 |
| 4,162,470 | 7/1979 | Smith . | |
| 4,215,013 | 8/1987 | Brunn et al. | 335/210 |
| 4,310,819 | 1/1982 | Morita et al. | 335/210 |
| 4,519,456 | 6/1979 | Smith . | |
| 4,714,908 | 12/1987 | Watabe et al. | 335/210 |

FOREIGN PATENT DOCUMENTS

| | | |
|---|---|---|
| 53-14462 | 12/1978 | Japan . |

*Primary Examiner*—Leo P. Picard
*Assistant Examiner*—Lincoln Donovan
*Attorney, Agent, or Firm*—Antonelli, Terry, Stout & Kraus

[57] ABSTRACT

In a proposed color cathode-ray tube with deflection yoke, adjustment of static convergence and purity is performed by controlling the polarities and magnetization forces of a plurality of pole pieces made of metal alloy circumferentially held around the outer periphery. Tap bolts pressing the external wall of a funnel nearly in the perpendicular direction are so disposed on a deflection yoke mounting member as to be adjacent to the funnel of the color cathode-ray tube. The tap bolts press the funnel to fix the deflection yoke.

60 Claims, 13 Drawing Sheets

COLOR CATHODE-RAY TUBE HAVING DEFLECTION YOKE

BACKGROUND OF THE INVENTION

The present invention relates to a color cathode-ray tube with deflection yoke having a magnet device for adjusting the static convergence and purity of a color cathode-ray tube by using external magnetization.

Adjustment of static convergence refers to performing adjustment so that three electron beams ejected from electron guns arranged in order of red (R), green (G) and blue (B) may overlap each other on one point at the center of the cathode-ray tube.

Adjustment of purity refers to performing adjustment so that the spot of an electron beam passed through a shadow mask may lie upon a pixel of a fluorescent luminous body with as small discrepancy as possible.

In order to absorb errors in components and fabrication nonuniformity, a magnet device for adjusting the static convergence and the purity at the central portion of the screen is mounted on a color cathode-ray tube.

As described in JP-B-51-45936 filed on June 10, 1972 by RCA Corporation, for example, a conventional magnet device comprises a plurality of magnet rings magnetized beforehand to have two, four or six poles and rotatably mounted around the neck portion of the color cathode-ray tube. These magnet rings are rotated for adjustment.

However, this structure has a very large number of components. Further, respective magnet rings must be magnetized with high precision, resulting in a high costs. Further, it is necessary to rely upon a highly skilled worker for adjustment. Adjustment in a short time is extremely difficult.

As methods for eliminating such problems, therefore, there were proposed in U.S. Pat. Nos. 3,725,831, 4,138,628, 4,159,456 and 4,162,470, for example, methods comprising the steps of wrapping a barium ferrite sheet directly around the neck section, fixing the barium ferrite sheet directly around the neck section, fixing the barium ferrite sheet by using a tie band or the like, applying magnetization with predetermined controlled strength to a plurality of locations on the above described barium ferrite sheet, and magnetizing the multiple poles so as to generate a magnetic field for realizing predetermined correction.

The above described prior art has problems described below. Since the barium ferrite sheet is used as the magnet member for magnetization, a change in magnetic flux density depending upon temperature is as large as approximately $-0.2\%/^{\circ}$ C. The characteristics change as the temperature of the neck section and the cabinet rises. The static convergence drift is large. In addition, it is difficult to hold the temperature characteristics with high precision which is needed in case fine characters are displayed.

Therefore, it is necessary to use a magnet material having excellent temperature characteristics such as rear-earth cobalt or Fe—Cr—Co. When such a magnet material is used, however, it is difficult to obtain a flexible sheet like material and an integrated structure unlike when a conventional magnet material is used. Even if an integrated structure is used, it is difficult to obtain magnetic field distribution because the permeability of the material is high. On the basis of these facts, it is necessary to dispose a plurality of independent pole pieces around the neck section and adjust the static convergence and purity characteristics by adjusting the amount of magnetization.

Further, the deflection yoke is conventionally fixed by inserting a wedge between the external periphery of funnel of the cathode-ray tube and the inside of the deflection yoke.

As literature relating to such a fixed structure, JP-A-51-55224 (U) filed on Oct. 25, 1974 by Tokyo Shibaura Electric Co., Ltd., IP-A-52-33215 (U) filed on Aug. 29, 1975 by Denki Onkyoh Co., Ltd., JP-A-52-68118 (U) filed on Nov. 17, 1975 by Denki Onkyoh Co., Ltd., JP-A-52-88517 (U) filed on Dec. 14, 1975 by Denki Onkyoh Co., Ltd., and JP-A-53-144620 filed on May 23, 1977 by Mitsubishi Electric Corporation, can be mentioned.

Such a method of inserting a wedge has problems that deviation of the position of the deflection yoke occurs when the wedge is inserted and faulty adjustment of convergence and purity occurs.

SUMMARY OF THE INVENTION

A first object of the present invention is to provide a magnet device which is excellent in temperature characteristics of static convergence and purity, which does not demand changing the position of the magnetic pole for adjustment, which allows magnetization from outside, which is free from influence of the amount of magnetization upon the mutual relation between magnetic poles, and which allows automatic magnetization.

A second object of the present invention is to provide a fixed structure of a deflection yoke which reduces the position deviation of the deflection yoke and which allows automatic fabrication.

The first object is achieved by fixing a plurality of pole pieces circularly on a ring-shaped holder, fixing this pole holder around the outer diameter section of the neck section together with other magnet rings for fine adjustment, and controlling the polarity and the amount of magnetization according to deviation of the electron beam by using a magnetizer disposed outside.

The second object is achieved by adopting such a structure that three or more female screw sections are disposed on the funnel of the deflection yoke and on an adapter fixed to the outer periphery of the funnel of the deflection yoke nearly at right angles to the funnel, and tap bolts are inserted into the female screw sections.

The tap bolts tighten an elastic material appearing as a cushion at the funnel side s that the elastic material may be pushed against the outer wall of the funnel.

First of all, the neck section side of the deflection yoke is fixed by a clamp band and a clamp screw, for example, in the same way as the prior art. When the tap bolts are then rotated and moved by using a torque driver or the like, front ends of the tap bolts are pressed against the funnel with constant pressure. That is to say, it is possible to fix the deflection yoke to the funnel section of the cathode-ray tube by pressure applied from the clamp section of the neck section side and the front end of the tap bolt.

In accordance with the present invention, adjustment of static convergence and purity is performed by using a plurality of independent pole pieces having a small temperature coefficient of magnetic flux change, resulting in excellent temperature characteristics of the cathode-ray tube. Further, magnetization for the pole pieces is automatically performed while the polarity and strength of magnetization is being controlled according to the situation of deviation of electron beams R, G and B by an external magnetizer. As a result, the conventional manual adjustment has been replaced by automatic adjustment.

The deflection yoke is fixed by pressing the outer periphery section of the funnel with constant pressure by using front ends of three or more tap bolts disposed at the deflection yoke side. Therefore, the position deviation of the deflection yoke is reduced, and faulty adjustment of static convergence and purity can be prevented.

Further, tightening of the tap bolts is automatically performed, and manual fixing operation using a wedge can be abolished.

BRIEF DESCRIPTION THE DRAWINGS

FIGS. 14A to 17C show relations between magnetization states of pole pieces and electron beams:

FIGS. 14A to 14H are diagrams used for explaining a first embodiment having eight pole pieces;

FIG. 16 is a diagram used for explaining a third embodiment having six pole pieces;

FIGS. 17A to 17C are diagrams used for explaining a case where six pole pieces are symmetrically disposed in the above described second embodiment.

Figure 22:
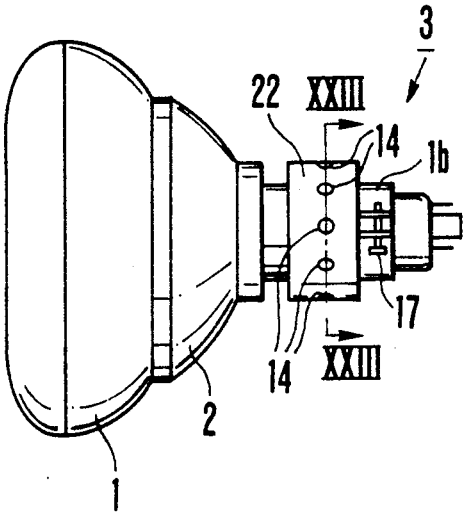

FIG. 22 another embodiment of a magnet device.

Figure 23:
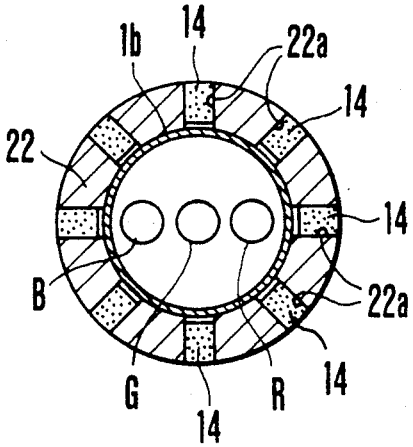

FIG. 23 is a sectional view of the magnet device seen along a line 23—23 shown in FIG. 22.

Figure 24:
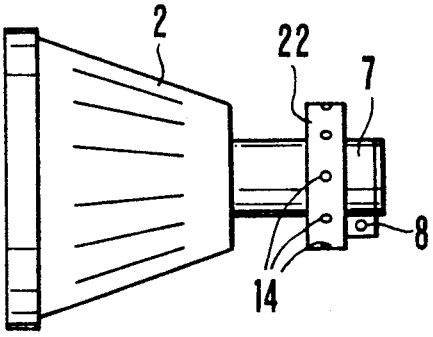

FIG. 24 shows integration of a deflection yoke and the magnet device.

DESCRIPTION OF THE PREFERRED EMBODIMENTS

Figure 1:
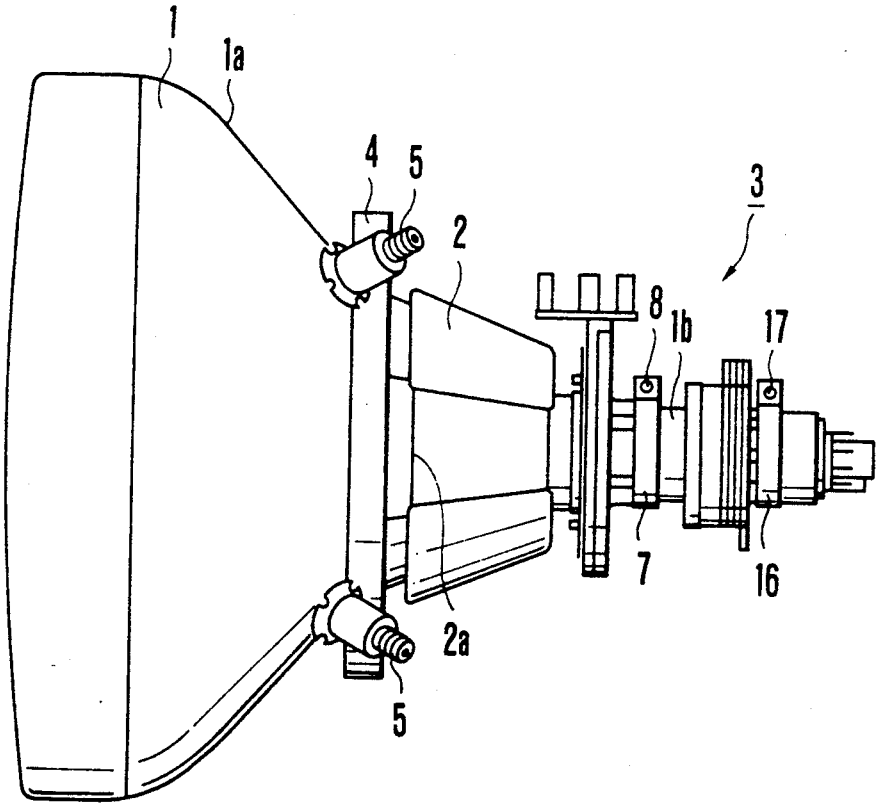
FIG. 1 is a side view of a color cathode-ray tube with deflection yoke according to an embodiment of the present invention.
Figure 2:
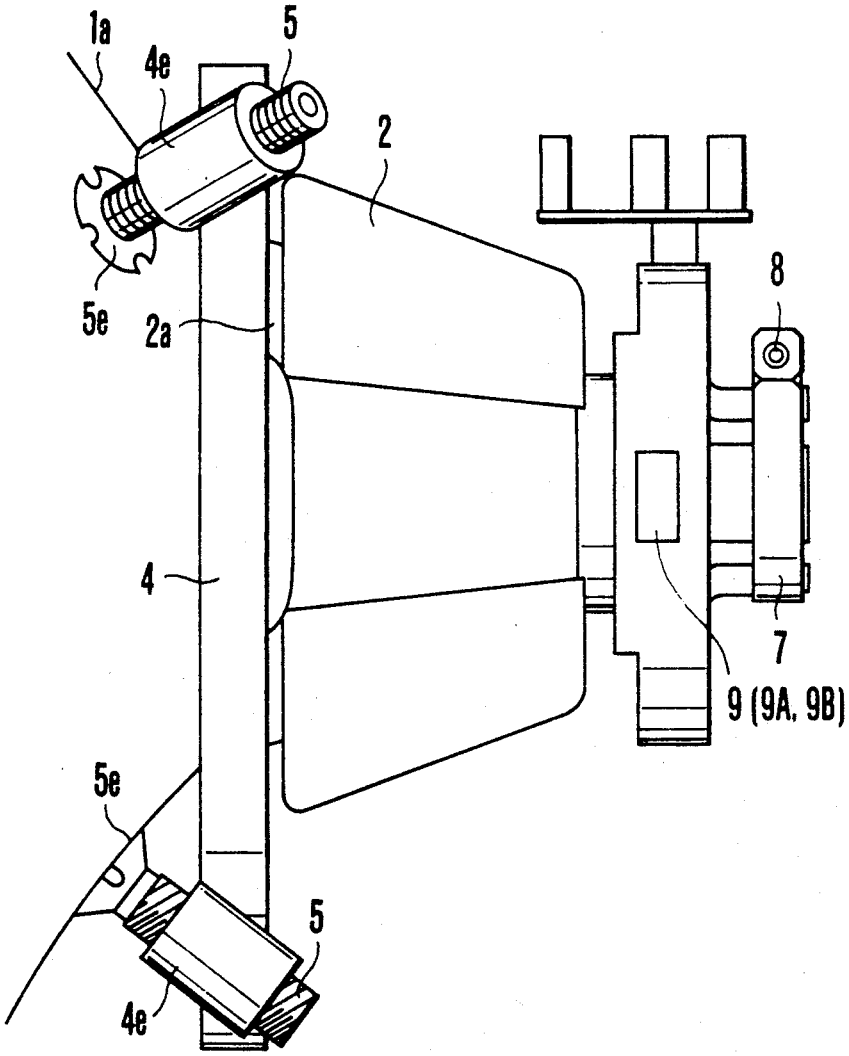
FIG. 2 is an enlarged side view of a deflection yoke section shown in FIG. 1.
Figure 3:
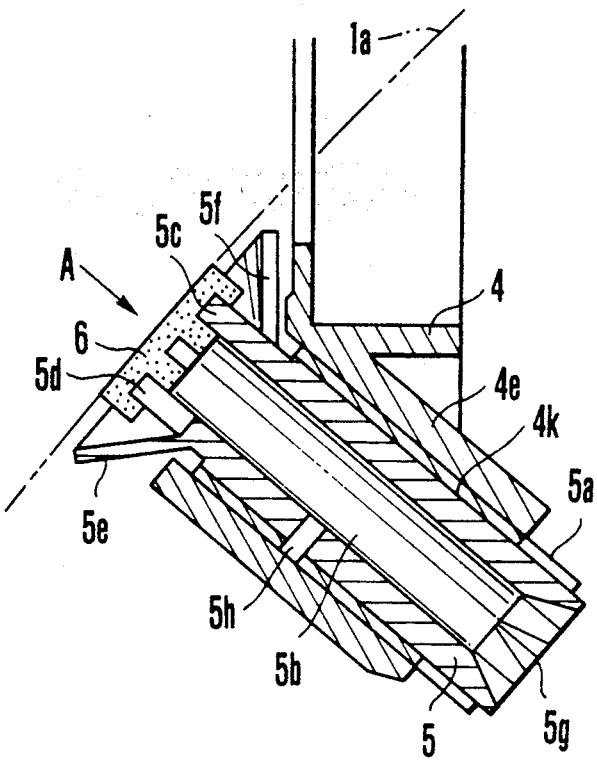
FIG. 3 is a sectional view of fixing means located at the funnel side of the deflection yoke.
Figure 5:
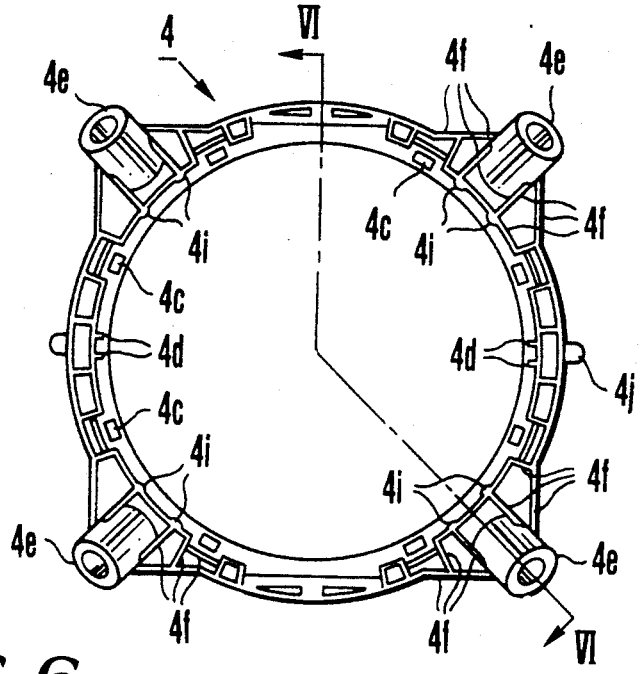
FIG. 5 is a rear view of an adaptor.
Figure 6:
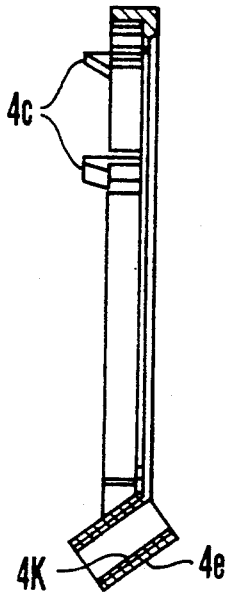
FIG. 6 is a sectional view of the adaptor when seen along a lien VI—VI shown in FIG. 5.
Figure 7:
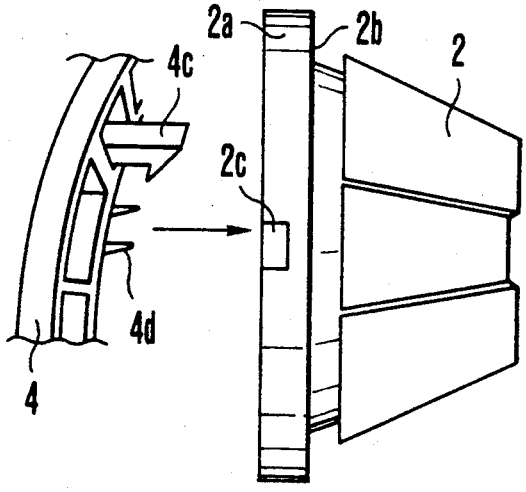
FIG. 7 is an oblique view of a coupling section between the section yoke and the adaptor.

An embodiment of the present invention will now be described by referring to drawings. As shown in FIG. 1, a deflection yoke 2 and a magnet device 3 for adjusting static convergence and purity are mounted on a color cathode-ray tube 1. First of all, a structure for fixing the deflection yoke will be described. Thereafter, the structure of the magnet device 3 will be described:

As shown in FIGS. 1 and 2, an adapter 4 is so fixed around the outer periphery of a conventional yoke mounting member 2*a* of the deflection yoke 2 as to be adjacent to a funnel section 1*a*. As shown in FIGS. 3, 5 and 6, the adapter 4 has a funnel insertion hole. The inside diameter of the funnel inserting hole is smaller than the outside diameter of the yoke mounting member 2*a*, but large enough for the funnel section 1*a* to be inserted therein. On the side face of the adapter 4, eight claws 4*c* engaging with a side face 2*b* (see FIG. 7) of the yoke mounting member 2*a* are disposed. On the yoke mounting member 2*a*, positioning notched grooves 2*c* (see FIG. 7) for accepting projections 4*d* formed on the side face of the adapter 4 are formed.

By aligning the projections 4*d* with the notched grooves 2*c* and pressing the adapter 4 against the yoke mounting member 2*a*, therefore, taper sections of the claws 4*c* are elastically expanded by the outer periphery of the yoke mounting member 2*a*. When front ends of the claws 4*c* are thus positioned on the side face 2*b* of the yoke mounting member 2*a*, the claws 4*c* elastically return to engage with the side face 2*b*. That is to say, as a result of engagement of the claws 4*c* with the side face 2*b*, the adapter 4 is coupled with the yoke mounting member 2*a* to form a single body. Further, as a result of acceptance of the projections 4*d* into the notched grooves 2*c*, the adapter 4 is positioned with the yoke mounting member 2*a* in the lateral direction, the longitudinal direction. On internal side faces of ribs 4*f*, projections 4*i* for elastically engaging with the outer periphery of the yoke mounting member 2*a* and thereby absorbing the torsion of the yoke mounting member 2*a* and nonuniformity of its outer periphery are formed. Further, on the outer periphery of the adapter 4, positioning notches 4, are formed for the purpose of positioning the color cathode-ray tube 1 and the deflection yoke 2 when they should be mounted and fixed on an adjustment apparatus which is not illustrated. On each of four supports 4*e* so formed on the adapter 4 as to be reinforced by the ribs 4*f*, a female screw section 4*k* is dispose. The axis of the female screw section 4*k* is nearly perpendicular to the outside contacting face of the funnel section 1*a*.

Figure 4:
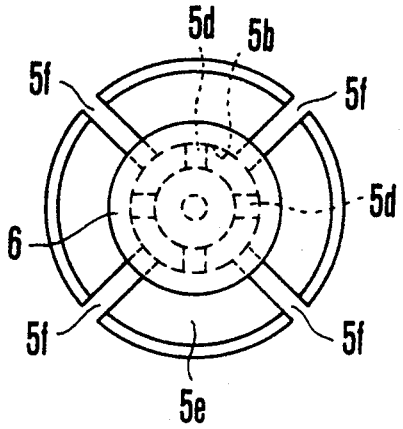
FIG. 4 is a view of the fixing means of FIG. 3 when seen from the direction of A indicated by an arrow.

The tap bolt 5 is screwed into the female screw section 4*k* of the above described support 4*e*. As shown in FIGS. 3 and 4, the outside diameter section of the tap bolt 5 becomes a male screw section 5*a* which is to be screwed into the above described female screw section 4*k*. A central hole 5*b* for injecting a binding agent is provided at the center of the tap bolt 5. In a front end section 5*c* of the tap bolt 5, a plurality of slits 5*d* communicating with the above described central hole 5*b* are formed. Further, a front end pad 6 comprising an elastic material such as rubber is pressed into the front end section 5c. In order to strengthen the fixation using the binding agent, a bevel section 5e is provided on the outer periphery of the front end section 5c. In this bevel section 5e, a slit 5f is provided between the above described slits 5d. The slits 5d are so formed as to be wider in width than the slits 5f. The binding agent flows to all positions located under the bevel section 5e through the slits 5d and 5f. In the rear end section of the tap bolt 5, a drive groove 5g is so formed as to allow insertion of a torque driver or the like. In the middle section of the central hole 5b, a hole 5h is opened at right angles to the central hole 5b.

Fixing of the deflection yoke 2 to the color cathode-ray tube 1 will now be described. The male screw section 5a of the tap bolt 5 having the front end pad 6 mounted thereon is screwed into the female screw 4k of the support 4e. In this way, the tap bolts 5 are mounted on the adapter 4 beforehand.

After the position adjustment of the deflection yoke 2 has been completed, the deflection yoke 2 is fixed at its neck section 1b side by a clamp band 7 and a clamp screw 8 in the same way as the prior art. A torque driver or the like is then inserted into the drive groove 5g of the tap bolt 5 mounted on the support 4e to rotate the tap bolt 5. As a result, the front end pad 6 is pressed against the funnel 1a with constant pressure. Since in this case the front end pad 6 comprises the elastic material it adheres closely to the funnel 1a. That is to say, the deflection yoke 2 is fixed to the funnel section 1a of the color cathode-ray tube 1 by pressure applied from the clamp section of the neck section 1b side and the front end pad 6 of the tap bolt 5.

Succeedingly, a binding agent which is not illustrated is pressed into the central hole 5b by external force. In this case, the binding agent injected into the central hole 5b enter the bevel section 5e through the slits 5d and flows toward the slits 5f. Since the slits 5d are displaced in position from the slits 5f, the bevel section 5e is filled with the binding agent and then the binding agent flows out through the slits 5f. Therefore, the bevel section 5de adheres closely to the funnel 1a, and the deflection yoke 2 is fixed to the funnel 1a by the tap bolt 5. Further, a part of the binding agent filling the central hole 5b flows to screw sections 4k and 5a through the hole 5h opened in the middle section of the central hole 5b. Therefore, position displacement of the crew sections 4k and 5a caused by backlash or the like is prevented.

In the above described embodiment, four female screw sections 4k are formed on the adapter 4, and four tap bolts 5 are mounted on the female screw sections. So long as the number of the female screw sections 4k is three or more, however, the function of fixing is efficiently fulfilled. Although the case where the adapter 4 is used has been described, the female screw section 4k may be disposed on the yoke mounting member 2a itself. If the adapter 4 is used as in the present embodiment, however, the conventional deflection yoke 2 can also be mounted, resulting in a merit. For the front end pad 6, a material which does not change in quality with respect to emitted X-rays must be used. In the present embodiment, silicon rubber is used.

As shown in FIG. 2, two arched misconvergence correction magnets 9 (9A, 9B) are so mounted on the yoke mounting member 2a as to be symmetric with respect to the neck section 1b.

Figure 8:
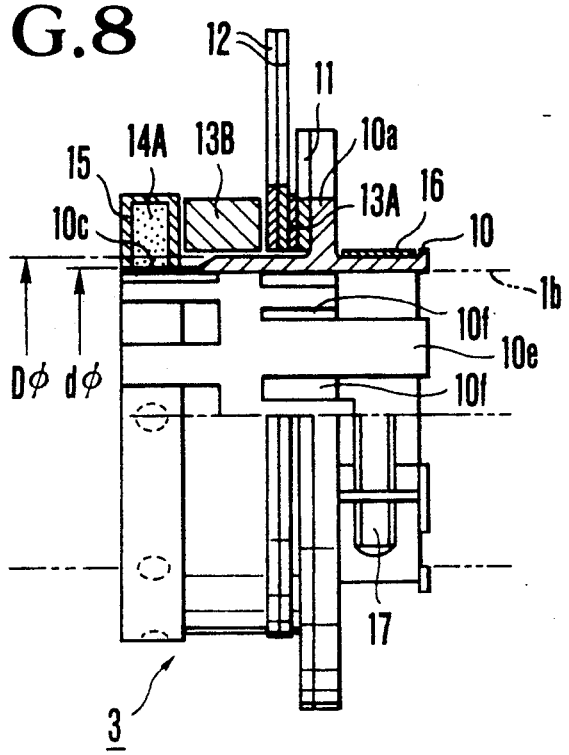
FIG. 8 is a partially sectional view of a magnet device.
Figure 9:
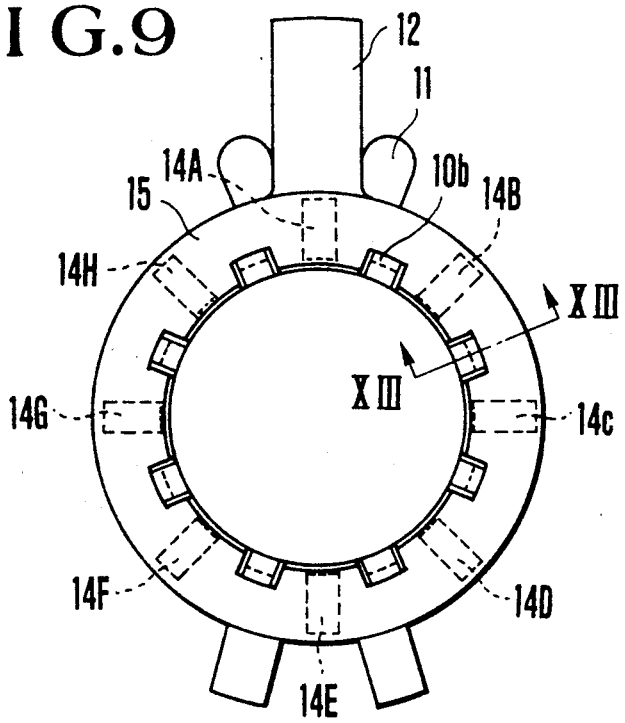
FIG. 9 is a side view of the magnet device of FIG. 8 seen from the left side.

The magnet device 3 will now be described by referring to FIGS. 8 to 13. As shown in FIGS. 8 and 9, a cylindrical neck section mounting member 10 comprising an electric insulating material such as plastics is mounted on the neck section 1b of the color cathode-ray tube 1. The neck section mounting member 10 has a collar section 10a. On the deflection yoke 2 side with respect to the collar section 10a, a fixing lock ring 11 comprising two sheets, a spacer 13A, a readjusting magnet ring 12, and a spacer 13B are mounted. The lock ring 11 and the magnet ring 12 are freely rotatable. In order to prevent joint rotation of the magnet ring 12 when the lock ring 11 is tightened, however, parts of inner peripheries of the spacers 13A and 13B are so formed as to be convex, and the neck section mounting member 10 is so formed as to be concave (10h of FIG. 11). Therefore, the magnet ring 12 can move in the cylinder axis direction, but cannot rotate. On the outer periphery of the front end section of the neck section mounting member 10, a magnetic pole holder 15 is so mounted as to be freely mountable and removable. The magnetic pole hole 15 comprises an electric insulating material such as plastics wherein a plurality of pole pieces 14A to 14H magnetized to adjust the static convergence and purity are circumferentially embedded.

The temperature change of the magnetic flux density in each of the above described pole pieces 14A to 14H must be small. Its suitable material is a magnet material comprising Fe—Cr—Co as the principal ingredient, a magnet material comprising a compound of a rare-earth element and Co as the principal ingredient, a magnet material comprising Al—Ni—Co as the principal ingredient, and a magnet material comprising Fe—Mn as the principal ingredient. Each of these magnet materials has a values of $-0.03\%/^{\circ}$ C. as the change of the magnetic flux density after magnetization dependent upon temperature. This value is as small as approximately 1/10 as compared with the conventional material. Even if the temperature of the neck section 1b rises during operation, therefore, the change of the magnetic flux density is small. Thus, the change in the amount of adjustment of static convergence and purity can be neglected for practical use. Above all, the magnet material comprising Fe—Cr—Co as the principal ingredient has coercive force ranging from 300 to 800 Oe, and can be easily controlled in strength of magnetization. Therefore, this magnet material is suitable to the pole pieces 14A to 14H used for the present invention.

The pole pieces 14A to 14H, the magnetic flux density of which does not largely change with temperature, are expensive because of use of scarce metals. Since each of the pole pieces 14A to 14H may have a small volume and may be used by a minute amount, however, it can be realized with a low cost. In the present embodiment, each of the pole pieces 14A to 14H has a size of 3.5 mm$\Phi\times$7 mm, for example.

Figure 11:
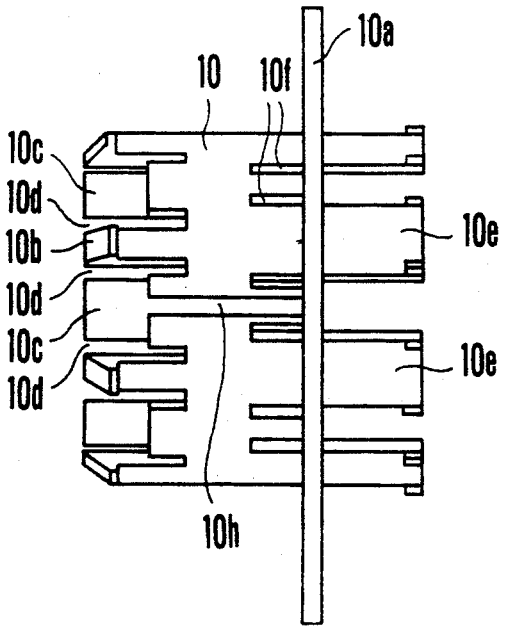
FIG. 11 is a side view of the mounting member shown in FIG. 10.
Figure 12:
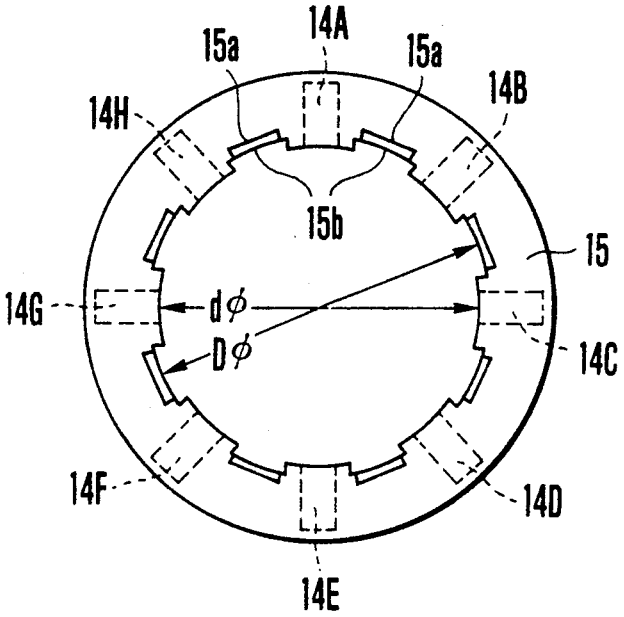
FIG. 12 is a front view of a magnetic pole holder.
Figure 13:
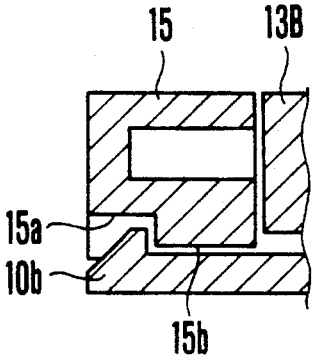
FIG. 13 is a sectional view of the magnet device seen along a line XIII—XIII shown in FIG. 9 and shows a structure for fixing the mounting member of the neck section and the magnetic pole holder.

The structure for mounting the magnetic pole holder 15 onto the neck section mounting member 10 will now be described. As shown in FIG. 13, a groove 15a is formed on the magnetic pole holder 15 between respective pole pieces among the pole pieces 14A to 14H. As shown in FIGS. 11 and 13, claw sections 10b engaging with the above described groove sections 15a are formed on the neck section mounting member 10. Between these claw sections 10b, i.e., in sections corresponding to the pole pieces 14A to 14H, insulating sections 10c are formed. Even when a pole piece is electrically grounded in case the insulation sections 10c are formed between the tube wall of the neck section 1b and the pole pieces, the electric gradient between the high voltage applied to the inner wall of the neck section 1b and the ground potential is mitigated by the insulating sections 10*c*, and the tube wall of the neck section is prevented from being destroyed. Slits 10*d* are provided in the axis direction between the claw sections 10*b* and the insulating sections 10*c* so that the claw sections 10*b* may be elastically bent inside. When the magnetic pole holder 15 is pressed in from the claw section 10*b* side of the neck section mounting member 10, therefore, the claw section 10*b* bends inside by the inner wall 15*b* of the magnetic pole holder 15 as shown in FIG. 13. When the claw section 10*b* is positioned on the groove section 15*a*, the claw section 10*b* returns to its original position by its elasticity. The magnetic pole holder 15 is put between the collar section 10*a* and the claw section 10*b* and is fixed on the neck section mounting member 10.

Figure 10:
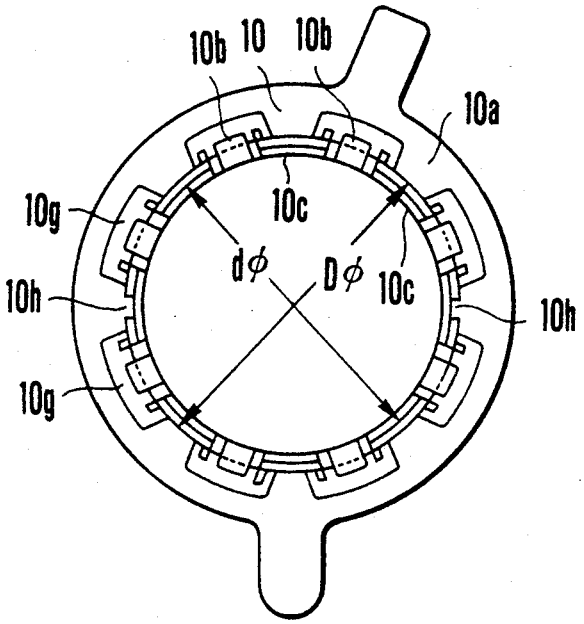
FIG. 10 is a front view of a mounting member of the neck section.

The insulating sections 10*c* of the neck section mounting member 10 corresponding to the hole pieces 14A to 14H are not provided with the mounting function. As shown in FIG. 10, therefore, outside diameter dΦ of the insulating section 10*c* can be so formed as to be smaller than insertion outside diameter DΦ of the neck section mounting member 10. The pole pieces 14A to 14H can be disposed nearer the tube wall of the neck section 1*b* by the amount of the above described reduction in the diameter of the insulating section 10*c*.

On a side of the neck section mounting member 10 opposing the mounting side of the magnetic pole holder, clamp reed sections 10*e* are formed. On both sides of the clamp reed section 10*e*, slits 10*f* are formed so that the clamp reed section 10*e* may have elasticity. The clamp reed section 10*e* is fixed to the neck section 1*b* by a clamp band 16 and a clamp bolt 17.

It is desirable that pole pieces are uniformly arranged on circumference of the magnetic pole holder 15. If the number of pole pieces is six or more, the object can be achieved.

In case the electron guns R, G and B are originally arranged nearer each other than the typical case and the amount of correction may be made small, it is possible to adjust the static convergence and purity by using a sheet like barium ferrite magnet and four pole pieces of the present invention.

In addition to fixed pole pieces, the present embodiment comprises a readjusting magnet ring 12 rotatably mounted on the neck section and magnetized beforehand. The magnet ring 12 for readjustment is incorporated into an apparatus for the customer and thereafter used for readjustment when deviation is caused in the adjustment of static convergence and purity under the influence of the magnetic field generated in the apparatus.

Magnetization of the pole pieces 14A to 14H will now be described. By mounting the deflection yoke 2 and the magnet device 3 onto the color cathode-ray tube 1 as shown in FIG. 1 and then applying magnetization corresponding to necessary correction values to the pole pieces 14A to 14H by using an external magnetizer, adjustment of the static convergence and purity is performed. Magnetization states of the pole pieces 14A to 14H will now be described by referring to FIGS. 14A to 14H. In FIGS. 14A to 14H, reference characters 18*b*, 18*g* and 18*r* respectively denote three electron beams for exciting blue, green and red phosphors to emit light. In FIGS. 14B to 14H, 18*b*, 18*g* and 18*r* are abbreviated to b, g and r, respectively.

Figure 14A:
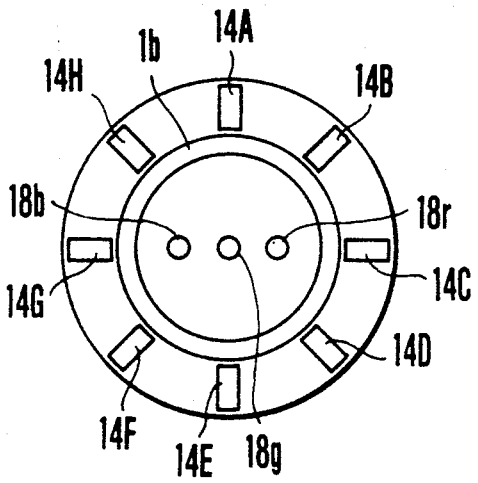
Figure 14B:
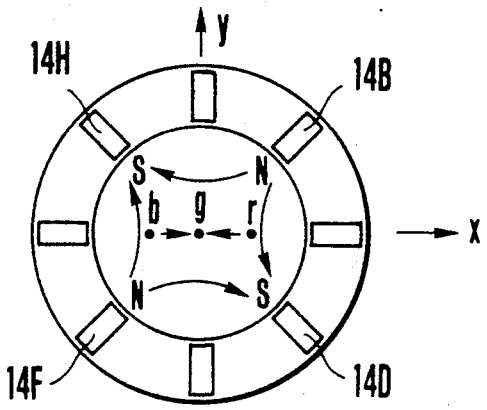

FIG. 14B shows the magnetization state obtained in case so-called correction of four-pole x-direction is performed by moving the b beam into the +x direction and moving the r beam into the −x direction by the identical amount without moving the g beam.

Figure 14C:
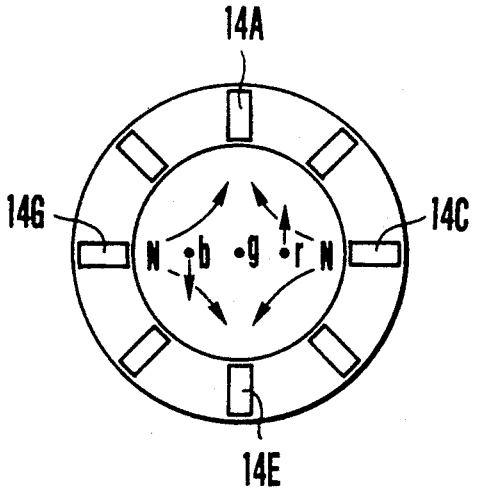

FIG. 14C shows the magnetization state obtained in case so-called correction of four-pole y-direction is performed by moving the b beam into the −y direction and moving the r beam into the +y direction without moving the g beam.

Figure 14D:
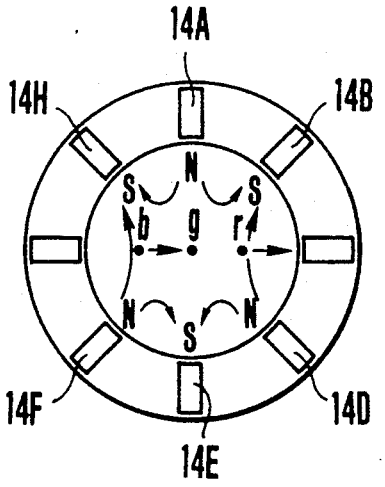

FIG. 14D shows the magnetization state obtained by moving the b and r beams into the +x direction without moving the g beam.

Figure 14E:
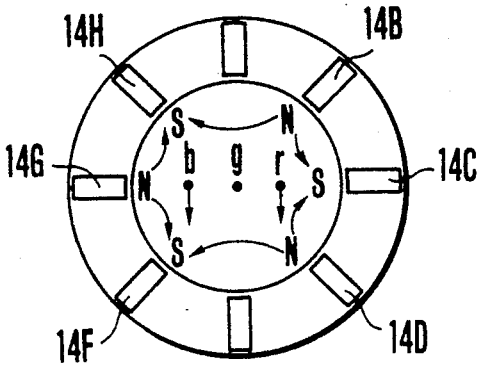

FIG. 14E shows the magnetization state obtained by moving the b and r beams into the −y direction without moving the g beam.

Figure 14F:
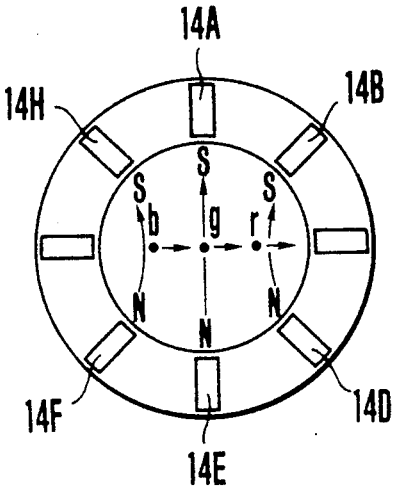

FIG. 14F shows the magnetization state obtained by moving the b, g and r beams into the x direction.

Figure 14G:
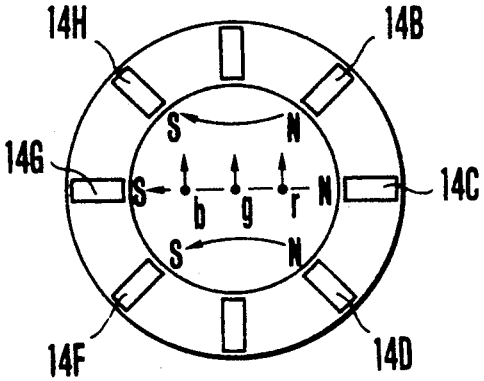
Figure 14H:
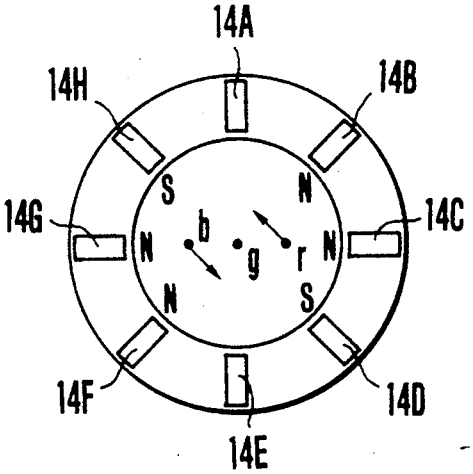

FIG. 14G shows the magnetization state obtained by moving the b, g and r beams into the +y direction.

In this way, correction in an arbitrary direction can be performed by arranging eight pole pieces 14A to 14H symmetrically at equal intervals and controlling the strength of eight magnetic poles. An arbitrary, further different correction can be performed by a combination of FIGS. 14B to 14G. For example, the magnetic field distribution shown in FIG. 14H can be obtained by combining the magnetic field distribution of FIG. 14B for performing the correction of four-pole x-direction and the magnetic field distribution of FIG. 14C for performing the correction of four-pole y-direction. By using the magnetic field distribution shown in FIG. 14H, the b and r beams can be corrected in slant directions opposing each other.

Figure 15A:
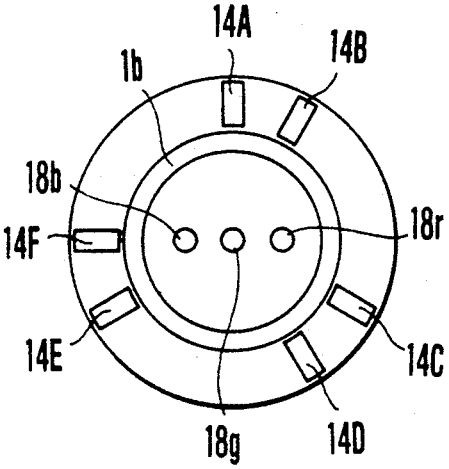
FIGS. 15A to 15C are diagrams used for explaining a second embodiment having six pole pieces.

In the description of the above described embodiment, correction is performed by using the eight pole pieces 14A to 14H. However, correction may also be performed by using six pole pieces. That is to say, the degree of freedom must be six for adjusting three electron beams 18*b*, 18*g* and 18*r* in the lateral direction (x direction) and the vertical direction (y direction) by arbitrary amounts of correction. This correction can be attained by arranging six pole pieces 14A to 14F unsymmetrically a shown in FIG. 15A.

Figure 15B:
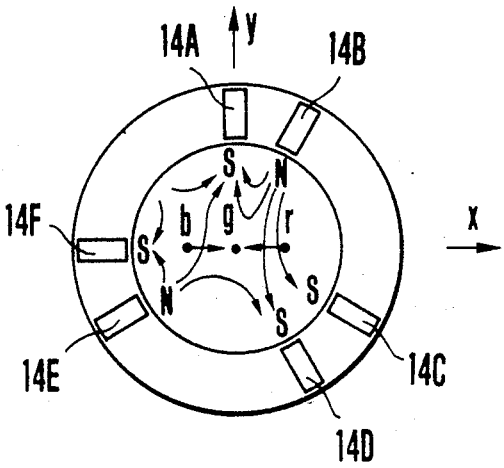
Figure 15C:
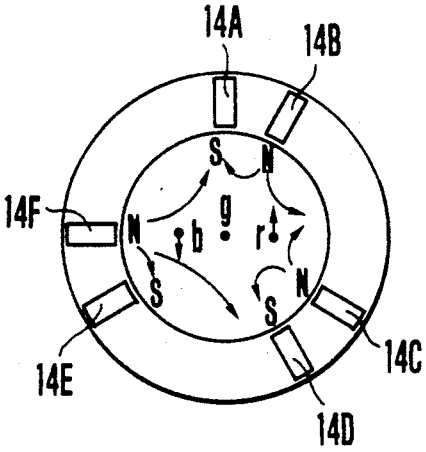
Figure 16:
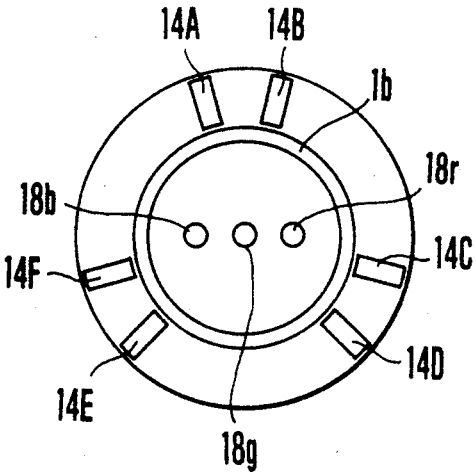

For example, FIG. 15B shows a case where correction of four-pole x-direction (i.e., the same correction as that of FIG. 14B) is performed. FIG. 15C shows a case where correction of four-pole y-direction (i.e., the same correction as that of FIG. 14C) is performed.

In this way, correction in arbitrary direction can be performed by controlling the amount of magnetization and the polarity without changing positions of six pole pieces 14A to 14F.

Although the description is omitted, the six pole pieces 14A to 14F may be disposed symmetrically with respect to the vertical axis.

Figure 17A:
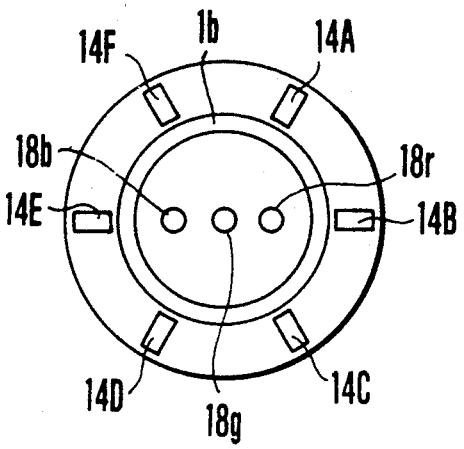
Figure 17B:
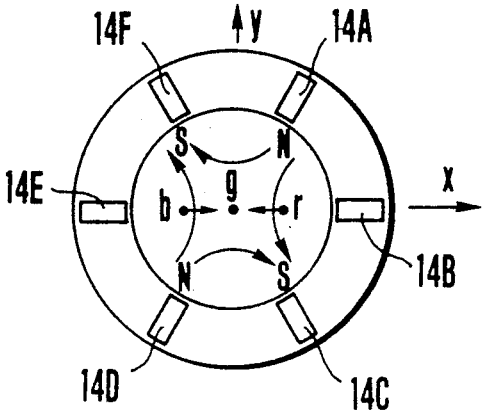

In case of FIGS. 15A to 15C and FIG. 16, the six pole pieces 14A to 14F are not disposed at equal intervals. If the six pole pieces 14A to 14F can be disposed at equal intervals and at symmetric positions as shown in FIGS. 17A to 17C, it is desirable to do so in improving the precision of components and precision of mounting positions.

Figure 17C:
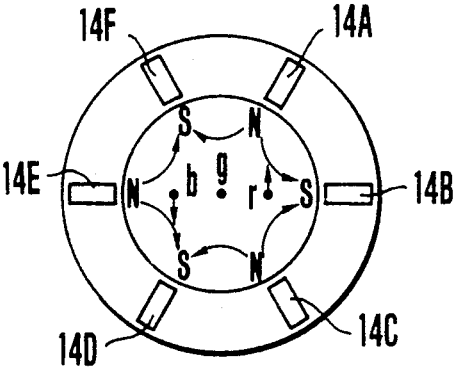

FIG. 17C shows a case where correction of six-pole y-direction is performed. All of absolute values of strength of magnetic poles are equal each other. Therefore, the resultant magnetic field distribution also has excellent symmetry. In this case, therefore, distortion of the magnetic field is mitigated as compared with the magnetic field distribution of FIG. 15C, and ill effects such as deterioration of focus characteristics of the electron beam are slight. Correction in the x direction is possible by using the correction of four-pole x-direction as shown in FIG. 17B.

Although correction can be performed in case six pole pieces 14A to 14F are used as well, it is desirable to use eight pole pieces 14A to 14H in view of symmetry of magnetic field in magnetization. Although description is omitted, ten or more pole pieces may also be used.

Figure 18A:
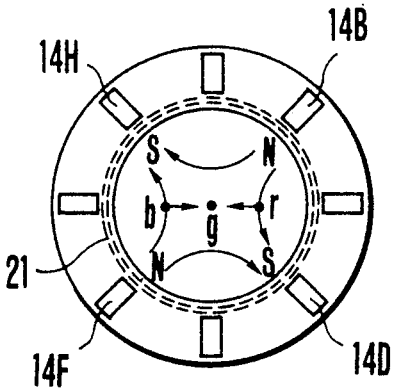
FIG. 18 is a diagram used for explaining a fourth embodiment in which 4 pole pieces are disposed and used together with a sheet like magnet.
FIG. 18B is a diagram showing the positional relationship of the pole pieces with respect to the sheet like magnet.
Figure 18B:
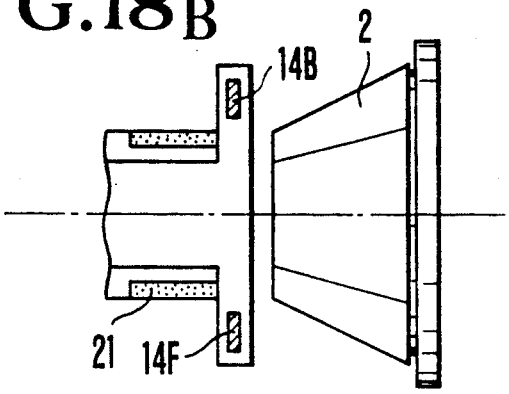

In the description of the above described respective embodiments, adjustment of six degrees of freedom of the three electron beams 18*b*, 18*g* and 18*r* is performed by using six or more pole pieces. However, this adjustment can also be performed by combining four pole pieces 14B, 14D, 14F and 14H shown in FIG. 18A with a sheetlike magnet 21 such as barium ferrite surrounding the neck section circumferentially. This embodiment will hereafter be described. FIG. 18B shows positional relationship between pole pieces and the sheetlike magnet.

In general, a change in magnetic flux density with temperature poses a problem when the amount of correction is large. The reason is as follows. If the amount of correction is originally small, the ratio of change in correction amount is small even if the magnetic flux density changes with temperature. For example, electron guns are arranged to be adjacent each other so that two side beams (r, b) may be disposed at a constant distance from the central beam (g) in opposing directions under the state that a correction magnetic field is absent. For example, the electron guns are arranged so that the two side beams (r, b) may be disposed on the display face of the cathode-ray tube at a distance of only approximately 1 to 2 mm, which is smaller than the typical value, from the central beam (g). Such a contrivance in design is adopted to facilitate manual adjustment. In this case, a correction magnetic field for this amount of deviation is formed by pole pieces 14B, 14D, 14F and 14H having small temperature coefficients, whereas a correction magnetic field for a smaller deviation (Such as approximately 0 to 0.3 mm) caused by nonuniformity of fabrication can be formed by using a sheetlike magnet such as cheap barium ferrite. In the present embodiment as well, joint use with the magnet ring 12 and the arched misconvergence correction magnet 9 is possible.

The magnet ring 12 for readjustment will now be described. After adjustment has been performed for a deviation caused by nonuniformity of fabrication or caused deliberately for the purpose of design, there is a possibility that convergence deviates for some cause. For example, operation condition at the time of adjustment differs in some cases from that after the cathode-ray tube is incorporated into a set together with other devices, resulting in slight deviation of static convergence. Once adjustment has been performed, however, it is difficult to perform readjustment because the magnetization states of respective pole pieces 14A to 14H must be changed. By providing the magnet ring 12, which comprises a combination of two sheets of four poles conventionally used, for the purpose of readjustment in order to cope with the above described situation, adjustment can be performed with respect to an error caused after shipment. It is desirable that the magnet ring 12 has coercive force higher than that of pole pieces so that the magnet ring 12 may not be affected when the pole pieces (14A to 14H) are magnetized. In the present embodiment, a ring of barium ferrite is used.

Figure 19:
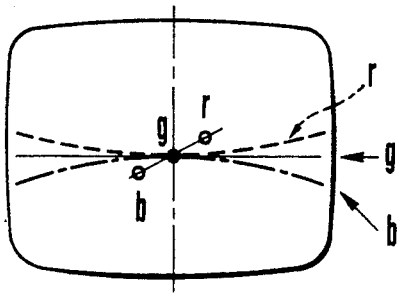
FIG. 19 is a diagram used for explaining arched misconvergence.
Figure 20:
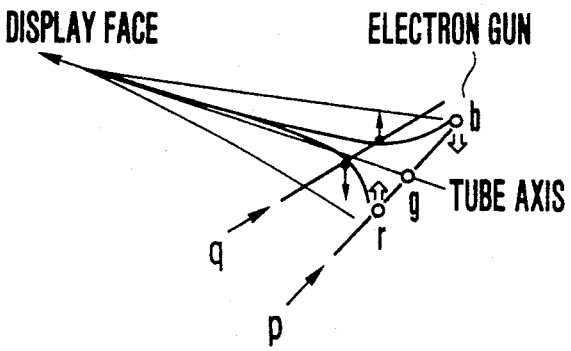
FIG. 20 is a diagram used for explaining correction of the arched misconvergence.

The arched misconvergence correction magnet 9 (9A, 9B) shown in FIG. 2 will now be described. The term "arched misconvergence" refers to such a color shift that the side beam r goes upward at both left and right ends of the screen and the other side beam b goes downward at both ends of the screen as shown in FIG. 19 or vice versa when the horizontal raster at the central part corresponding to the center beam g is properly adjusted to be horizontal. This is caused when three electron guns are so mounted as to be inclined with respect to the horizontal axis. In general, this can be corrected by bending the r and b beams in opposing vertical directions twice at two different positions p and q located on the tube axis as shown in FIG. 20. That is to say, in the example of FIG. 20, the r beam is bent upward and the b beam is bent downward a the position p. Subsequently at the position q, the r beam is bent downward and the b beam is bent upward. Tracks of the beams r and b are thus modified.

The arched misconvergence correction magnet 9 is provided to correct arched misconvergence in combination with the above described magnet device 3. In case of the example shown in FIG. 20, the magnet device 3 corrects the r beam upward and the b beam downward at the position p, whereas the arched misconvergence correction magnet 9 modifies the beam track at the position q.

Figure 21A:
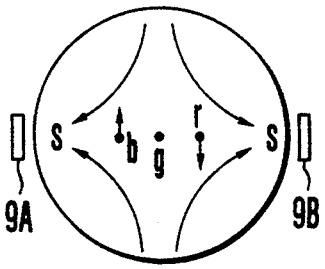
FIGS. 21A and 21B are diagrams used for explaining correction performed by an arched misconvergence correction magnet.

In order to modify the beam track at the position q, the arched misconvergence correction magnets A and 9B are magnetized to have an identical polarity as shown in FIG. 21A and produce a correction magnetic field for moving the r beam and the b beam in vertical directions opposing each other. In this case, magnetic poles 14A to 14H or 14A to 14F within the magnetic device 3 are preferably magnetized so as to contain magnetic field components as shown in FIG. 14C or FIG. 5C, respectively.

Figure 21B:
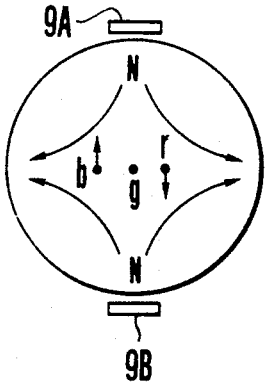

In the configuration shown in FIG. 21A, the arched misconvergence correction magnets 9A and 9B are disposed on the horizontal axis. Even if the arched misconvergence correction magnets 9A and 9B are disposed on the vertical axis as shown in FIG. 21B, however, similar effects can be obtained.

Other embodiments of the magnet device are shown in FIGS. 22 to 24.

As shown in FIG. 22, a pole piece holder 22 is tightened and fixed to the neck section 1*b* by the clamp band 16 and a fixing screw 17. The pole piece holder 22 comprises a nonmagnetic material having a plurality of pole piece insertion holes 22*a* radially formed. Pole pieces 14 made of metal alloy such as rare-earth cobalt or Fe—Cr—Co alloys are inserted into respective pole piece insertion holes 22*a* and fixed.

FIG. 23 is a sectional view seen along a line 23—23 shown in FIG. 22. Magnetization patterns are the same as those shown in FIGS. 14A to 14H, and magnetization is performed by an external magnetizer. Depending upon magnetization patters shown in FIGS. 15A to 15C, FIG. 16, FIGS. 17A to 17C, and FIGS. 18A and 18B, the number of pole pieces is selected to be four or more. Although not illustrated, it is a matter of course that joint use with the magnet ring 12 and the sheetlike magnet 21 is possible in the same way as the above described embodiments.

In the above described embodiment, the magnetic pole holder 15 is formed separately from the neck section mounting member 10. However, they may be formed as one body. Further, the neck section mounting member and the yoke mounting member 2a may also be formed as one body. FIG. 24 shows an embodiment in which the pole piece holder 22 is integrated with the yoke mounting member on the rear part of the deflection yoke 2.

We claim:

1. A color cathode-ray tube with deflection yoke, comprising:

(a) red, green and blue electron guns arranged around a neck section of said color cathode-ray tube;

(b) magnetic pole holding means for circumferentially holding a plurality of pole pieces made of metal alloy around an outer periphery of said neck section at predetermined intervals, said magnetic pole holding means having an electric insulating material between said pole pieces and a tube wall of said neck section;

(c) an adapter so mounted on a deflection yoke mounting member as to be adjacent to a funnel of said color cathode-ray tube, said adapter comprising three or more tap bolts mounted nearly perpendicular to an outer wall of said funnel, a deflection yoke being fixed to said color cathode-ray tube by tightening said tap bolt; and (d) means for fixing a part of said deflection yoke mounting member adjacent to said electron gun to said neck section.

2. A color cathode-ray tube according to claim 1, further comprising a freely rotatable ring-shaped magnetic member having a plurality of magnetic poles around the outer periphery of said neck section.

3. A color cathode-ray tube according to claim 1, further comprising two magnets magnetized to have an identical polarity, said two magnets being so disposed on a horizontal axis or a vertical axis as to sandwich said neck, said two magnets being disposed at positions closer to a display face than said pole pieces of said neck section.

4. A color cathode-ray tube according to claim 1, further comprising two magnets magnetized to have an identical polarity, said two magnets being so disposed on a horizontal axis or a vertical axis as to sandwich said neck, said two magnets being disposed at positions closer to a display face than said pole pieces of said neck section.

5. A color cathode-ray tube according to claim 1, wherein said pole pieces comprise either a magnet material comprising Fe—Cr—Co as the principal ingredient, or alternatively a magnet material comprising a compound of a rare-earth element and Co as the principal ingredient, or alternatively a magnet material comprising Al—Ni—Co as the principal ingredient, or alternatively a magnet material comprising Fe—Mn as the principal ingredient.

6. A color cathode-ray tube according to claim 2, wherein said pole pieces comprise either a magnet material comprising Fe—Cr—Co as the principal ingredient, or alternatively a magnet material comprising a compound of a rare-earth element and Co as the principal ingredient, or alternatively a magnet material comprising Al—Ni—Co as the principal ingredient, or alternatively a magnet material comprising Fe—Mn as the principal ingredient.

7. A color cathode-ray tube according to claim 3, wherein said pole pieces comprise either a magnet material comprising Fe—Cr—Co as the principal ingredient, or alternatively a magnet material comprising a compound of a rare-earth element and Co as the principal ingredient, or alternatively a magnet material comprising Al—Ni—Co as the principal ingredient, or alternatively a magnet material comprising Fe—Mn as the principal ingredient.

8. A color cathode-ray tube according to claim 4, wherein said pole pieces comprise either a magnet material comprising Fe—Cr—Co as the principal ingredient, or alternatively a magnet material comprising a compound of a rare-earth element and Co as the principal ingredient, or alternatively a magnet material comprising Al—Ni—Co as the principal ingredient, or alternatively a magnet material comprising Fe—Mn as the principal ingredient.

9. A color cathode-ray tube according to claim 2, wherein said ring-shaped magnetic member has a coercive force higher than that of said pole pieces.

10. A color cathode-ray tube according to claim 4, wherein said ring-shaped magnetic member has a coercive force higher than that of said pole pieces.

11. A color cathode-ray tube according to claim 6, wherein said ring-shaped magnetic member has a coercive force higher than that of said pole pieces.

12. A color cathode-ray tube according to claim 8, wherein said ring-shaped magnetic member has a coercive force higher than that of said pole pieces.

13. A color cathode-ray tube according to claim 1, wherein said tap bolt comprises an elastic material so disposed at a front end thereof as to be adjacent to said funnel.

14. A color cathode-ray tube according to claim 13, wherein said elastic material comprises a silicon elastic material.

15. A color cathode-ray tube according to claim 13, wherein said tap bolt comprises a hollow structure having an opening section at the tightening side of said tap bolt, and said tap bolt comprises a groove leading from said hollow section to surroundings of said elastic material, whereby a binding agent injected from said tightening side fills the surroundings of said elastic material through said hollow section and said groove to strengthen fixation of said elastic material.

16. A color cathode-ray tube according to claim 14, wherein said tap bolt comprises a hollow structure having an opening section at the tightening side of said tap bolt, and said tap bolt comprises a groove leading from said hollow section to surroundings of said elastic material, whereby a binding agent injected from said tightening side fills the surroundings of said elastic material through said hollow section and said groove to strengthen fixation of said elastic material.

17. A color cathode-ray tube according to claim 15, wherein said tap bolt comprises a groove leading from said hollow section to the female screw side engaging with said tap bolt, whereby said binding agent flowing through said groove leading to the female screw side prevents position displacement of said tap bolt and said female screw.

18. A color cathode-ray tube according to claim 16, wherein said tap bolt comprises a groove leading from said hollow section to the female screw side engaging with said tap bolt, whereby said binding agent flowing through said groove leading to the female screw side prevents position displacement of said tap bolt and said female screw.

19. A color cathode-ray tube according to claim 1, wherein said pole piece holding means is formed with said deflection yoke mounting member as one body.

20. A color cathode-ray tube according to claim 2, wherein said pole piece holding means is formed with said deflection yoke mounting member as one body.

21. A color cathode-ray tube according to claim 3, wherein said pole piece holding means is formed with said deflection yoke mounting member as one body.

22. A color cathode-ray tube according to claim 4, wherein said pole piece holding means is formed with said deflection yoke mounting member as one body.

23. A color cathode-ray tube according to claim 1, wherein said pole piece holding means comprising:

(1) a pole piece holding member for mounting said pole pieces thereon;

(2) a support member for fixing said pole piece holding member so as to be freely mountable and removable; and (3) means for fixing said support member onto said neck sec ion.

24. A color cathode-ray tube according to claim 2, wherein said pole piece holding means comprises:

(1) a pole piece holding member for mounting said pole pieces thereon;

(2) a support member for fixing said pole piece holding member so as to be freely mountable and removable and (3) means for fixing said support member onto said neck section.

25. A color cathode-ray tube according to claim 3, wherein said pole piece holding means comprises:

(1) a pole piece holding member for mounting said pole pieces thereon;

(2) a support member for fixing said pole piece holding member so as to be freely mountable and removable; and (3) means for fixing said support member onto said neck section.

26. A color cathode-ray tube according to claim 4, wherein said pole piece holding means comprises:

(1) a pole piece holding member for mounting said pole pieces thereon;

(2) a support member for fixing said pole piece holding member so as to be freely mountable and removable; and (3) means for fixing said support member onto said neck section.

27. A color cathode-ray tube according to claim 23, wherein said pole piece holding means is so formed that an inside diameter of a pole piece mounting section of said pole piece holding member may be smaller than an inside diameter of a face of said pole piece holding member brought into contact with and supported by said support member.

28. A color cathode-ray tube according to claim 24, wherein said pole piece holding means is so formed that an inside diameter of a pole piece mounting section of said pole piece holding member may be smaller than an inside diameter of a face of said pole piece holding member brought into contact with and supported by said support member.

29. A color cathode-ray tube according to claim 25, wherein said pole piece holding means is so formed that an inside diameter of a pole piece mounting section of said pole piece holding member may be smaller than an inside diameter of a face of said pole piece holding member brought into contact with and supported by said support member.

30. A color cathode-ray tube according t claim 26, wherein said pole piece holding means is so formed that inside diameter of a pole piece mounting section of said pole piece holding member may be smaller than inside diameter of a face of said pole piece holding member brought into contact with and supported by said support member.

31. A color cathode-ray tube according to claim 19, wherein said pole piece holding means comprises a pole piece insertion hole radially formed.

32. A color cathode-ray tube according to claim 20, wherein said pole piece holding means comprises a pole piece insertion hole radially formed.

33. A color cathode-ray tube according to claim 21, wherein said pole piece holding means comprises a pole piece insertion hole radially formed.

34. A color cathode-ray tube according to claim 22, wherein said pole piece holding means comprises a pole piece insertion hole radially formed.

35. A color cathode-ray tube according to claim 1, wherein said adapter is formed with said deflection yoke mounting member as one body.

36. A color cathode-ray tube according to claim 2, wherein said adapter is formed with said deflection yoke mounting member as one body.

37. A color cathode-ray tube according to claim 3, wherein said adapter is formed with said deflection yoke mounting member as one body.

38. A color cathode-ray tube according to claim 4, wherein said adapter is formed with said deflection yoke mounting member as one body.

39. A color cathode-ray tube according to claim 1, wherein the number of said pole pieces is six or more.

40. A color cathode-ray tube according to claim 2, wherein the number of said pole pieces is six or more.

41. A color cathode-ray tube according to claim 3, wherein the number of said pole pieces is six or more.

42. A color cathode-ray tube according to claim 4, wherein the number of said pole pieces is six or more.

43. A color cathode-ray tube with deflection yoke, comprising:

(a) red, green and blue electron guns arranged around a neck section of said color cathode-ray tube;

(b) magnetic pole holding means for circumferentially holding a plurality of pole pieces made of metal alloy around an external periphery of said neck section at predetermined intervals, said magnetic pole holding means having an electric insulating material between said pole pieces and a tube wall of said neck section;

(c) an adapter so mounted on a deflection yoke mounting member as to be adjacent to a funnel of said color cathode ray tube, said adapter comprising three or more tap bolts mounted nearly perpendicular to an outer wall of said funnel, a deflection yoke being fixed to said cathode-ray tube by tightening said tap bolt;

(d) means for fixing a part of said deflection yoke mounting member adjacent to said electron gun to said neck section; and (e) a sheetlike magnet circumferentially wrapped around the outer periphery of said neck section at a position different from that of said pole piece holding means.

44. A color cathode-ray tube according to claim 43, further comprising a freely rotatable ring-shaped magnetic member having a plurality of magnetic poles around the outer periphery of said neck section.

45. A color cathode-ray tube according to claim 43, further comprising two magnets magnetized to have an identical polarity, said two magnets being so disposed on a horizontal axis or a vertical axis as to sandwich said neck, said two magnets being disposed at positions closer to a display face than said pole pieces of said neck section.

46. A color cathode-ray tube according to claim 44, further comprising two magnets magnetized to have an identical polarity, said two magnets being so disposed on a horizontal axis or a vertical axis as to sandwich said neck, said two magnets being disposed at positions closer to a display face than said pole pieces of said neck section.

47. A color cathode-ray tube according to claim 43, wherein said pole pieces comprise either a magnet material comprising Fe—Cr'Co as the principal ingredient, or alternatively a magnet material comprising a compound of a rare-earth element and Co as the principal ingredient, or alternatively a magnet material comprising Al—Ni—Co as the principal ingredient, or alternatively a magnet material comprising Fe—Mn as the principal ingredient.

48. A color cathode-ray tube according to claim 44, wherein said pole pieces comprise either a magnet material comprising Fe—Cr—Co as the principal ingredient, or alternatively a magnet material comprising a compound of a rare-earth element and Co as the principal ingredient, or alternatively a magnet material comprising Al—Ni—Co as the principal ingredient, or alternatively a magnet material comprising Fe—Mn as the principal ingredient.

49. A color cathode-ray tube according to claim 45, wherein said pole pieces comprise either a magnet material comprising Fe—Cr—Co as the principal ingredient, or alternatively a magnet material comprising a compound of a rare-earth element and Co as the principal ingredient, or alternatively a magnet material comprising Al—Ni—Co as the principal ingredient, or alternatively a magnet material comprising Fe—Mn as the principal ingredient.

50. A color cathode-ray tube according to claim 46, wherein said pole pieces comprise either a magnet material comprising Fe—Cr—Co as the principal ingredient, or alternatively a magnet material comprising a compound of a rare-earth element and Co as the principal ingredient, or alternatively a magnet material comprising Al—Ni—Co as the principal ingredient, or alternatively a magnet material comprising Fe—Mn as the principal ingredient.

51. A color cathode-ray tube according to claim 44, wherein said ring-shaped magnetic member has a coercive force higher than that of said pole pieces.

52. A color cathode-ray tube according to claim 46, wherein said ring-shaped magnetic member has a coercive force higher than that of said pole pieces.

53. A color cathode-ray tube according to claim 48, wherein said ring-shaped magnetic member has a coercive force higher than that of said pole pieces.

54. A color cathode-ray tube according to claim 50, wherein said ring-shaped magnetic member has a coercive force higher than that of said pole pieces.

55. A color cathode-ray tube according to claim 43, wherein the number of said pole pieces is four or more.

56. A color cathode-ray tube according to claim 44, wherein the number of said pole pieces is four or more.

57. A color cathode-ray tube according to claim 45, wherein the number of said pole pieces is four or more.

58. A color cathode-ray tube according to claim 46, wherein the number of said pole pieces is four or more.

59. A color cathode-ray tube according to claim 1, wherein said magnetic pole holding means holds said plurality of pole pieces at said predetermined intervals about said neck for magnetization of said pole pieces by an external magnetizer so as to enable adjustment of static convergence and purity without requiring adjustment of the pole pieces.

60. A color cathode-ray tube according to claim 43, wherein said magnetic pole holding means holds said plurality of pole pieces at said predetermined intervals about said neck for magnetization of said pole pieces by an external magnetizer so as to enable adjustment of static convergence and purity without requiring adjustment of the pole pieces.

* * * * *